US006101930A

United States Patent [19]

Van Over

[11] Patent Number: 6,101,930

[45] Date of Patent: Aug. 15, 2000

[54] OVEN INSERT FOR IMPROVED BAKING

[76] Inventor: Charles Van Over, 49 Ferry Rd., P.O. Box 449, Chester, Conn. 06412

[21] Appl. No.: 09/154,438

[22] Filed: Sep. 16, 1998

[51] Int. Cl.[7] ..... F24C 15/32; F24C 15/34

[52] U.S. Cl. ..... 99/426; 99/422; 99/449; 126/12; 126/22; 126/273.5

[58] Field of Search ..... 99/422, 426, 441, 99/449; 126/22, 12, 273.5, 400

[56] References Cited

U.S. PATENT DOCUMENTS

| | | | |
|---|---|---|---|
| 1,971,903 | 8/1934 | Cohen | 99/426 |
| 3,659,585 | 5/1972 | Bay | 126/390 |
| 4,127,108 | 11/1978 | Krohe | 126/369 |
| 4,640,265 | 2/1987 | Romo | 126/273.5 X |
| 4,644,858 | 2/1987 | Liotto et al. | 99/449 |
| 4,706,832 | 11/1987 | Citino | 126/12 |
| 4,973,566 | 11/1990 | Readey et al. | 501/129 |
| 5,232,609 | 8/1993 | Prevost et al. | 99/426 X |
| 5,334,242 | 8/1994 | O'Toole | 106/711 |
| 5,367,951 | 11/1994 | Purvis | 99/450 |
| 5,501,142 | 3/1996 | Bailey | 99/482 |

FOREIGN PATENT DOCUMENTS

| | | | |
|---|---|---|---|
| 850513 | 9/1952 | Germany | 126/273.5 |
| 3602398 | 8/1987 | Germany | 126/273.5 |

OTHER PUBLICATIONS

Karl–Heinz Häussler GmbH Catalog article titled "Mono Electric Baking Oven", 1996.

Superstone catalog titled "Bread Bakers", 1997.

Chef's catalog, p. 49, titled "Toastmaster Breadmaker and Oven", 1997.

Chef's catalog, p. 93, titled "Hot Bricks", 1997.

*Primary Examiner*—Reginald L. Alexander

*Attorney, Agent, or Firm*—Pearne & Gordon LLP

[57] ABSTRACT

A baking device for use in a domestic oven. The baking device is composed of refractory insulating material and includes a base and a pair of walls. The base is generally rectangular and has a pair of spaced-apart grooves formed therein. The walls are generally rectangular and have concave interior surfaces. The walls have bottom edges adapted for insertion into the grooves so as to mount the walls to the base. When the walls are mounted to the base, the baking device is generally channel-shaped, creating a partially curvilinear baking surface resembling a "c" in cross-section.

29 Claims, 5 Drawing Sheets

OVEN INSERT FOR IMPROVED BAKING

FIELD OF THE INVENTION

The present invention relates to the field of ovens in general and, more particularly, to an oven insert for retrofitting preexisting domestic ovens in a manner that allows a user to emulate the same baking effects in a conventional oven that can otherwise only be achieved in a commercial hearth.

BACKGROUND OF THE INVENTION

A conventional domestic oven includes an enclosure comprised of sheet metal coated with enamel. At least one heating device is provided inside the enclosure to generate heat for baking food, such as bread. The heating device is typically mounted at the bottom of the enclosure and may be a gas burner, or an electric resistance heating element.

The heating element heats the air at the bottom of the enclosure, thereby creating a temperature gradient that causes the heated air to rise and circulate within the enclosure. The circulating air heats the walls and roof of the enclosure, charging the oven until the thermostat indicates that it has reached a desired temperature. At this point, food being baked, including, for example, bread is disposed in the enclosure, and is then baked by the combination of ambient heat from the heated air, and radiant heat from the heating element and the heated walls of the enclosure.

Typically, the heating device is cycled on and off in response to air temperature in the enclosure, which will vary because of the temperature gradient and insulatory capacity of the oven, and when the oven door is opened. It is also dependent upon the thermal retention properties of the enamelized metal, which is generally conductive and does not store heat as efficiently as other baking materials. As a result, the temperature around the food material may fluctuate by as much as 75° F. during the baking process. Such temperature fluctuations cause cooking to occur unevenly. In the case of baking bread, such thermal fluctuations result in lack of uniformity in rising, surface color, and crust development, and in certain instances cause burning of the bread.

In commercial hearth ovens, heat fluctuations are moderated by the use of refractory insulatory materials that retain and dispense heat in a far more efficient and uniform manner than their domestic enamelized metal counterparts. Additionally, for baking bread, the direct contact between the specialized material in the commercial oven and the dough itself, causes a different style of baking—one that simply cannot be effectively achieved in a standard domestic oven. Moreover, commercial hearth ovens are expensive and large, and hence do not find their typical place in a domestic home.

Baking stones are sometimes inserted in domestic ovens as a "heat sink" to retain heat for more even baking. However, such conventional baking stones are typically rectangular, with planar surfaces and a narrow thickness. Such baking stones, however, do not retain a large amount of heat and emit heat only in one direction with regard to the bread. Most importantly, because the stone lacks side walls, food material like bread is heated even less uniformly than in a typical domestic oven, especially because the side heat dispensed to the food material arises predominantly from the enamelized side walls. As a result, the chamber of insulatory material that is provided in a commercial hearth oven is in no manner recreated in a domestic oven when a baking stone is merely used.

In an attempt to overcome the restrictions inherent in a domestic oven, Krohe, in U.S. Pat. No. 4,127,108 shows a device comprised of a refractory stoneware which is essentially a completely enclosed chamber that is placed in the domestic oven, and, after heating, the domestic oven is then shut off. Krohe, however, fails to utilize certain of the advantages of a domestic oven, and to combine those advantages with certain of the advantages of stoneware. As a result Krohe is almost a "mini" commercial hearth oven placed in a domestic oven. Beyond the mere limitation in space thereby created and the resultant inability to bake anything other than rye bread, Krohe fails to utilize the thermal radiant heat properties of the roof of a domestic oven, and thus has not effectively solved the problem.

U.S. Pat. No. 4,706,832 to Citino essentially shows a cookie sheet (comprised of aluminum) having a plurality of quarry tiles placed upon the sheet, for insertion into a domestic oven. This device fails to achieve the desired results because the materials selected are of insufficient density and thickness to retain necessary heat to improve baking, the discontinuity in the tiles is apt to create thermal pockets, and the absence of side wall enclosure allows the enamelized walls of the conventional domestic oven to burn bread and other food material that is baked.

Accordingly, there is a need in the art for a baking device that can be inserted into a domestic oven to provide the substantial equivalent of a commercial hearth oven with a minimum of materials, utilizing materials having the necessary thermal properties, proper dimensions, and proper configuration to combine certain of the beneficial properties of the domestic oven with the thermal capacitive properties of stoneware.

SUMMARY OF THE INVENTION

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

It therefore would be desirable, and is an advantage of the present invention, to provide a baking device for use in a domestic oven. In accordance with the present invention, the baking device includes a base and side walls composed of refractory insulating material. Side walls extend upwardly from the base, substantially proximate to the internal side walls of the oven. The height of the side members is determined in a manner sufficient to provide a distance from the uppermost portion of the base to the roof of the oven that is between 6.5 and 9.5 inches, preferably 9 and 9.5 inches. In this manner, the oven roof is used as part of the baking chamber. The height of the side walls are also between 5 and 9.5 inches, preferably 9 and 9.5 inches. In this manner, the side walls are taller than the bread or other food material being baked, so that the radiant heat from the combination of the walls and the base, as well as the conventional heat from the ambient air and the top (or roof) of the oven create a uniform baking field. resulting in bread and other food material having substantially all of the same excellence that can be found in a commercial hearth oven. Accordingly, in a preferred embodiment, the baking device side members are concavely curved in order to create a contiguous baking surface resembling a "c" in cross-section. A refractory insulating material (typically cordierite) is also utilized.

BRIEF DESCRIPTION OF THE DRAWINGS

The features, aspects, and advantages of the present invention will become better understood with regard to the following description, appended claims, and accompanying drawings where:

DETAILED DESCRIPTION OF THE PREFERRED EMBODIMENTS

Figure 1:
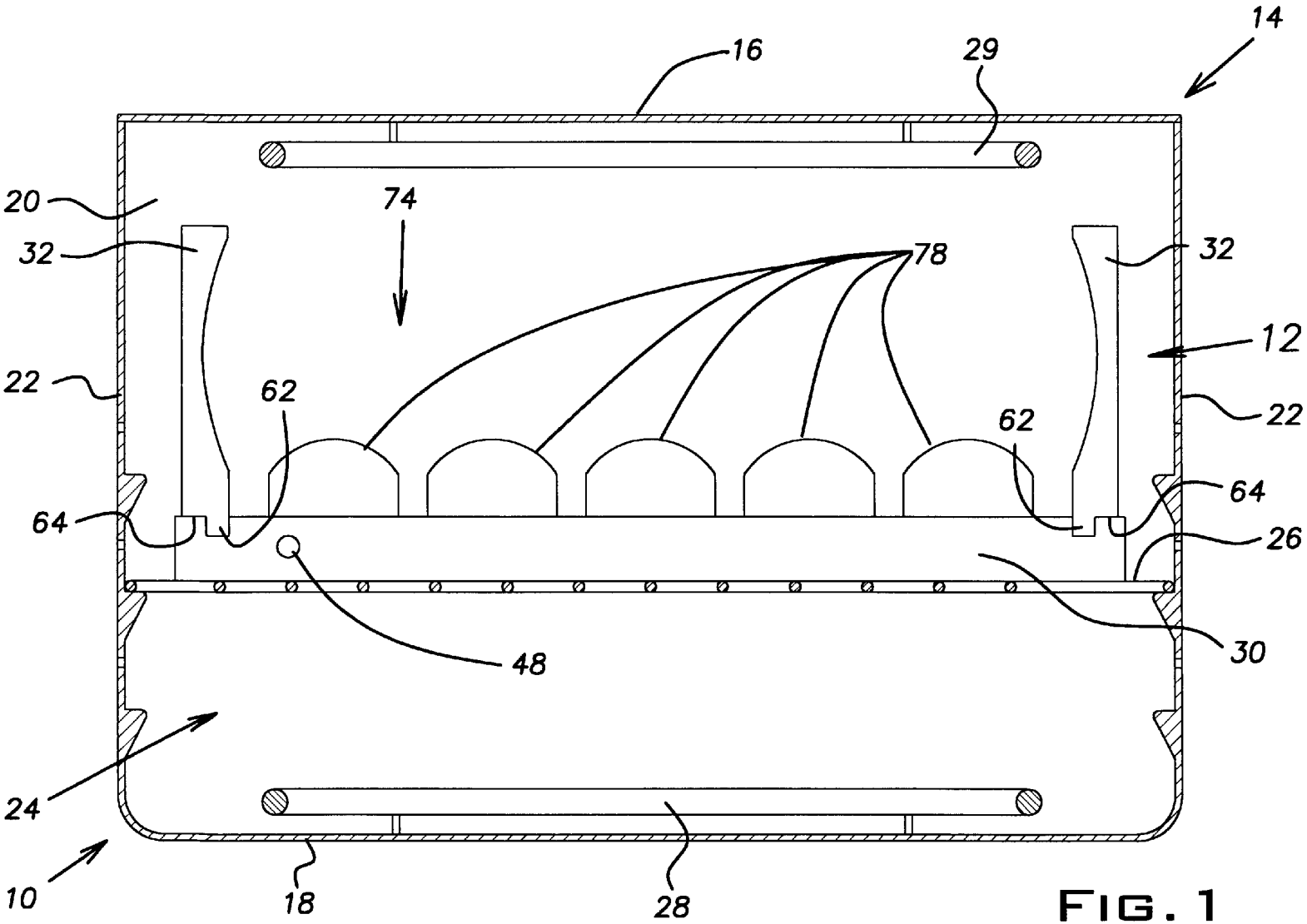
FIG. 1 shows a front sectional view of a portion of an oven having the oven insert disposed therein, in accordance with a preferred embodiment of the subject invention.

It should be noted that in the detailed description which follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

FIG. 1 shows a front sectional view of a portion of an oven 10, such as a domestic electric oven, in which an oven insert baking device 12 according to the invention has been placed. Oven 10 comprises a chamber 14 having a top wall 16, a bottom wall 18, a rear wall 20, and opposing side walls 22. All of the walls of chamber 14 are typically comprised of an enamalized metal material, as is conventionally well-known.

Enclosure 12 defines a baking chamber 24 in which the food material is placed for baking, as described in further detail, below. A door (not shown) is pivotably connected to enclosure 14 and is movable between a closed position, wherein the door covers a front opening, and an open position, wherein the door is displaced from the front opening. A wire rack 26 is disposed inside baking chamber 24 and is movably mounted in one of a plurality of vertical positions. In order to heat baking chamber 24, an electric resistance heating element 28 is secured to bottom wall 18, and a control device (not shown) is provided for controlling the supply of electricity to heating element 28 in response to the air temperature in the baking chamber 14. Also, a broiler element 29 is provided in a typical domestic oven. For baking, resistance heating element 28 is employed, and the broiler element 29 is not involved. Alternatively, the oven includes a gas burner or other heater.

Figure 2:
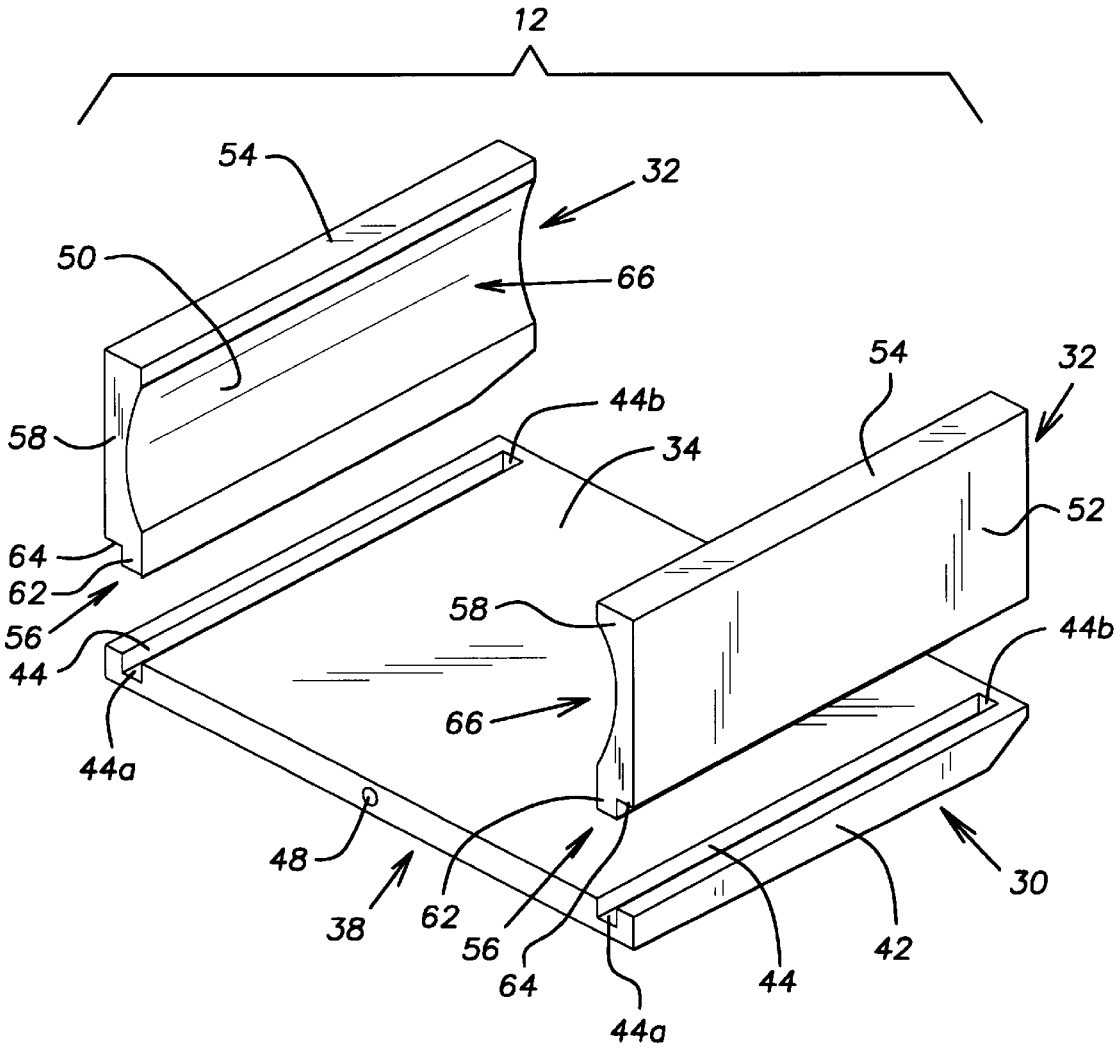
FIG. 2 shows an exploded front perspective view of the oven insert in accordance with the instant invention.

FIG. 2 shows an exploded view of an oven insert, baking device 12 of the present invention. Baking device 12 is comprised of base 30 and a pair of opposing side walls 32. The base 30 and the side walls 32 are preferably composed of a refractory insulating material. As used herein, the term "refractory insulating material" shall mean a solid material that can withstand temperatures greater than 600° F. and has low thermal and electrical conductivity. Examples of refractory insulating materials include refractory stone formed from cement loaded with fillers, such as glass, and refractory ceramic formed from fire clay, or cordierite powder 2 (Mg, Fe) $O.2Al_2O_3.5SiO_2$. Preferably, the base 30 and the side walls 32 are composed of refractory ceramic formed from cordierite powder ("cordierite ceramic"). Cordierite ceramic is lightweight, has a low coefficient of thermal expansion, a low thermal conductivity, and can withstand temperatures tip to 2000° F. It is preferred that the cordierite ceramic as used herein have the following composition in weight percent:

| | |
|---|---|
| $SiO_2$ | about 50–60, more preferably about 52.9 |
| $Al_2O_3$ | about 30–40, more preferably about 35.7 |
| MgO | about 5–15, more preferably about 8.6 |
| $Fe_2O_3$ | about 0–2, more preferably about 1.2 |
| $TiO_2$ | about 0–1, more preferably about .9 |
| CaO | about 0–1, more preferably about .3 |
| Alkalies | about 0–1, more preferably about .4 |

The preferred cordierite ceramic also generally has the following thermal properties:

| | |
|---|---|
| Maximum Service Temperature | 2300° F. |
| Coefficient of Thermal Expansion | $14.1 \times 10^{-7}$ in/in/° F. |

The preferred cordierite also generally has the following physical properties:

| | |
|---|---|
| Cold Modulus of Rupture (psi) | 2586 |
| Absorption (%) | 13.4 |
| Apparent Porosity (%) | 26.2 |
| Bulk Density (g/cc) | 1.95 |
| Apparent Specific Gravity (g/cc) | 2.64 |

Figure 3:
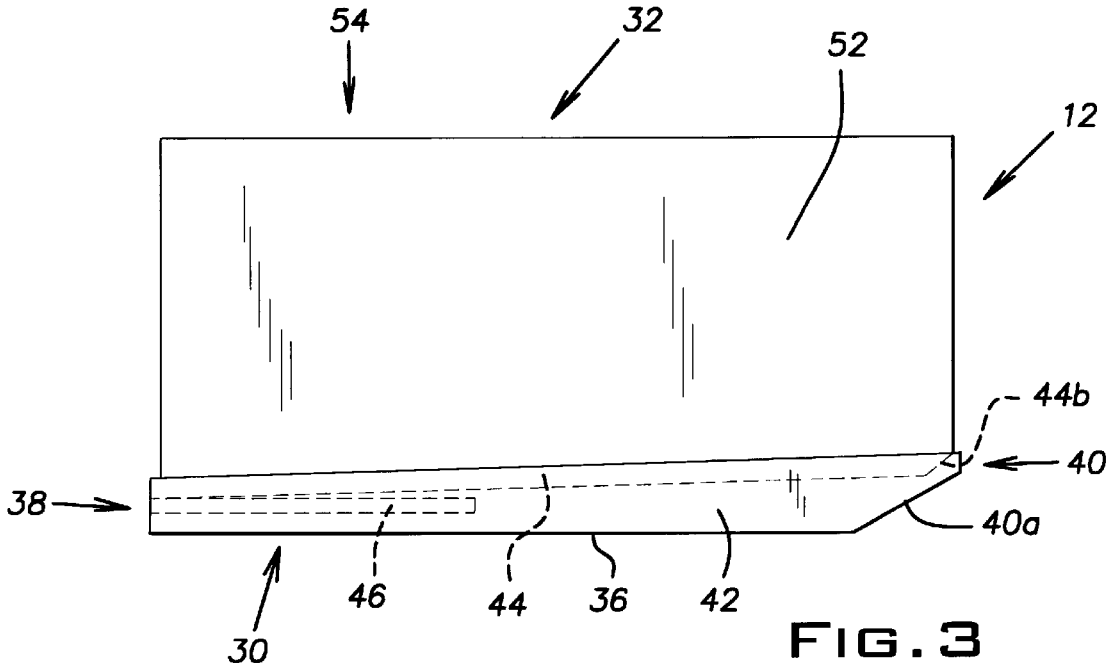
FIG. 3 shows an exterior side view of an oven insert having a side wall inserted into, or placed upon the base.

FIG. 3 shows a side view of the oven insert 12. A base 30 of the insert 12 is generally rectangular and has top and bottom surfaces 34, 36, anterior and posterior ends 38, 40, and opposing sides 42. Top surface 34 is planar and slopes downwardly from the posterior end 40 to the anterior end 38. Preferably, top surface 34 has a downward slope in a range of about 1° to 3°, more preferably about 1.5°. The downward slope of top surface 34 facilitates the placement of food onto base 30 before baking and facilitates the removal of food from base 30 after baking. The angle is such to not interfere with the cooking properties of the device, while providing necessary ease of placement and removal of the food material.

Posterior end 40 of base 30 extends downwardly from top surface 34 at a substantially right angle for a distance and then slopes forwardly and downwardly to bottom surface 36. In this manner, posterior end 40 has an inwardly-sloping bottom portion 40*a* that assists the sliding action of base 30 over protrusions that are normally present in wire rack 26.

Base 30 has a width extending between sides 42, a thickness extending between top and bottom surfaces 34, 36, and a length extending between anterior and posterior ends 38, 40. The width of base 30 substantially traverses the distance between side walls 22 of the oven, and the length is substantially the extent of the depth of oven 14. In this manner, when side walls 32 are placed upon base 30, side walls 32 are substantially proximate to side walls 22 of the oven. As a result, the amount of airspace between the side walls of the oven and the side walls of the oven insert are minimized to reduce or prevent thermal changes that would exist if a cavity were created. Accordingly, the dimensions of the base may vary to the extent that the internal dimensions of the oven vary in order to minimize such a cavity effect.

The thickness of the insulating material forming the base 30 is preferably in a range of about 1" to 2", and preferably 1" to 1.5". The composition of the insulating material, as well as its thickness are selected to provide proper density to balance the thermal insulating abilities against the need to keep the device as light weight as possible to ease its insertion into the oven. More preferably, the thickness is about 1⅛" to 1¼" at the posterior end 40 and 1" at the anterior end 38 so as to provide top surface 34 with the downward slope and give base 30 a slightly wedge-shaped profile.

In a preferred embodiment, a pair of grooves 44 are formed in top surface 34 of base 30. Grooves 44 are respectively disposed toward, and extend along, the sides 42 of base 30. Preferably, grooves 44 are spaced inwardly from sides 42 about 0.25" to 0.75", more preferably about 0.5". Each of the grooves 44 has a front portion 44*a* extending through the anterior end 38 and a rear portion 44*b* disposed just inward of the posterior end 40. Rear portions 44*b* slope upwardly and rearwardly (as best shown in phantom in FIG. 3). Preferably, grooves 44 have substantially uniform depths and widths. The width of each groove 44 is preferably in a range of about 0.25" to 0.75", more preferably about 0.5". The depth of each groove 44 is preferably in a range of about 0.25" to 0.75", more preferably about 0.375".

A bore 46 may be formed in the base 30 to receive a thermometer for measuring the temperature of the baking device 12. Bore 46 extends inwardly from an access opening 48 formed in the anterior end 38. Preferably, bore 46 is disposed about 3 inches from side wall 62 and midway between top and bottom surfaces 34, 36. Bore 46 preferably extends inwardly about 3" to 9", more preferably about 6". The diameter of bore 46 is preferably in a range of about 0.06" to about 0.5".

Figure 4:
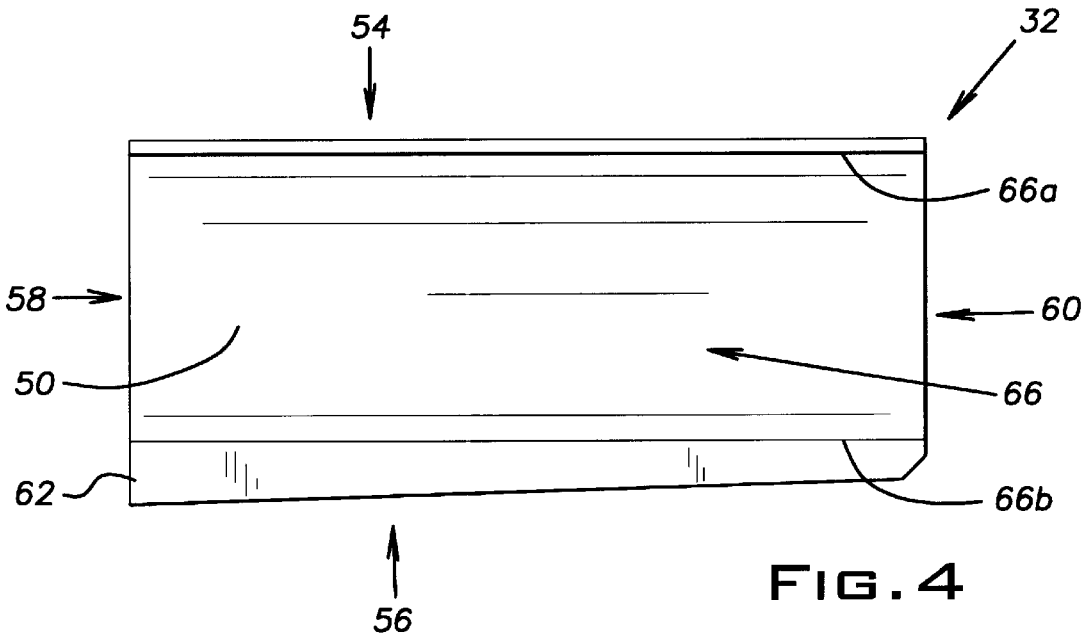
FIG. 4 shows an interior side view of a side wall of the oven insert, independent of the base.

Referring now to FIGS. 2 and 4, side walls 32 of baking device 12 are mirror images of each other. Each side wall 32 is generally rectangular and has inner and outer surfaces 50, 52, top and bottom edges 54, 56, and front and rear ends 58, 60. Preferably, bottom edge 56 of each side wall 32 slopes downwardly from rear end 60 to front end 58 so as to complement the downward slope of the top surface 34 of the base 30.

Each side wall 32 has a length extending between front and rear ends 58, 60, a height extending between top and bottom edges 54, 56, and a thickness extending between inner and outer surfaces 50, 52. Preferably, the length of each side wall 32 is coextensive with the length of the base 30. The thickness of each side wall 32 at the top end is preferably about ⅞". The height of each side wall 32 is preferably in a range of about 5" to 9.5", preferably 6.5" to 9.5". In this manner, the combination of side walls 62 and base 30, together with roof 16 of the oven create a chamber effect, with a substantial minimization of space between device 12 and the interior of oven 14. The height of side walls 32 allow the side walls 32 to traverse a good portion of the distance between base 30 and oven roof 16. Generally the distance between base 30 and roof 16 is between 6.5" and 9.5", preferably 9" to 9.5". These dimensions depend, to some extent on the size and configuration of broiler element 29. Device 12 is configured to avoid contacting the broiler element 29.

In one embodiment, bottom edge 56 of each side wall 32 is notched and has a tongue or tenon 62 extending downwardly from a shoulder surface 64. (It should be appreciated that elimination of the notch/tenon effect will not deviate from the scope of the invention.) Tenons 62 have widths slightly smaller than the widths of grooves 44 so as to be receivable therein. Preferably, tenons 62 have depths about the same as the depths of grooves 44. Shoulder surfaces 64 preferably have widths slightly less than the spacings between grooves 44 and sides 42 of base 30.

The outer surface 52 of each side wall 32 is substantially planar, whereas the inner surface 50 of each side wall 32, in a preferred embodiment, is concave between the top and bottom edges 54, 56 so as to form an arcuate recess 66. As best show in FIG. 4, the recess 66 in each side wall 32 has an upper boundary 66*a* preferably spaced about ¼" below the top edge 54 and a lower boundary 66*b* that is preferably spaced about 1" above the bottom of the tenon 62 at the front end 58 and is spaced about ⅝" above the bottom of the tenon 62 at the rear end 60. Preferably, each side wall 32 has a thickness of ⅜" at the center of curvature of the recess 66. In this manner, the concavity provides heat concentration in normal use of the device, as discussed below.

Figure 5:
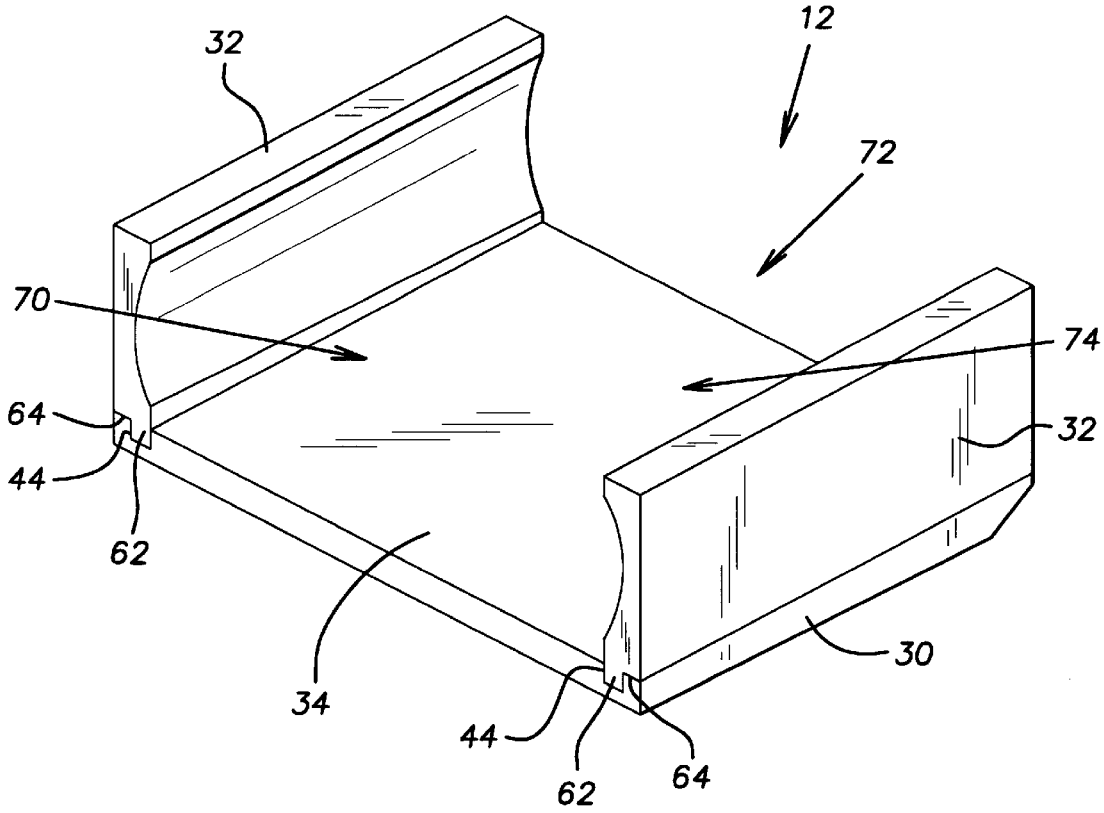
FIG. 5 shows a perspective front view of the oven insert device in fully assembled form.

Side walls 32 are assembled on base 30 by disposing tenons 62 in grooves 44 such that recesses 66 in side walls 32 face each other. When baking device 12 is assembled as shown in FIG. 5, baking device 12 is generally channel-shaped, having a "C" cross-section, and having open front and rear ends 70, 72 and an open top 74. Tenons 62 are disposed in grooves 44 and shoulder surfaces 64 adjoin top surface 34 of base 30. Side walls 32 extend upwardly from base 30 at substantially right angles. The complementary downward slopes of bottom edges 56 of side walls 32 and top surface 34 of base 30 provide baking device 12 with a substantially uniform height.

Figure 6:
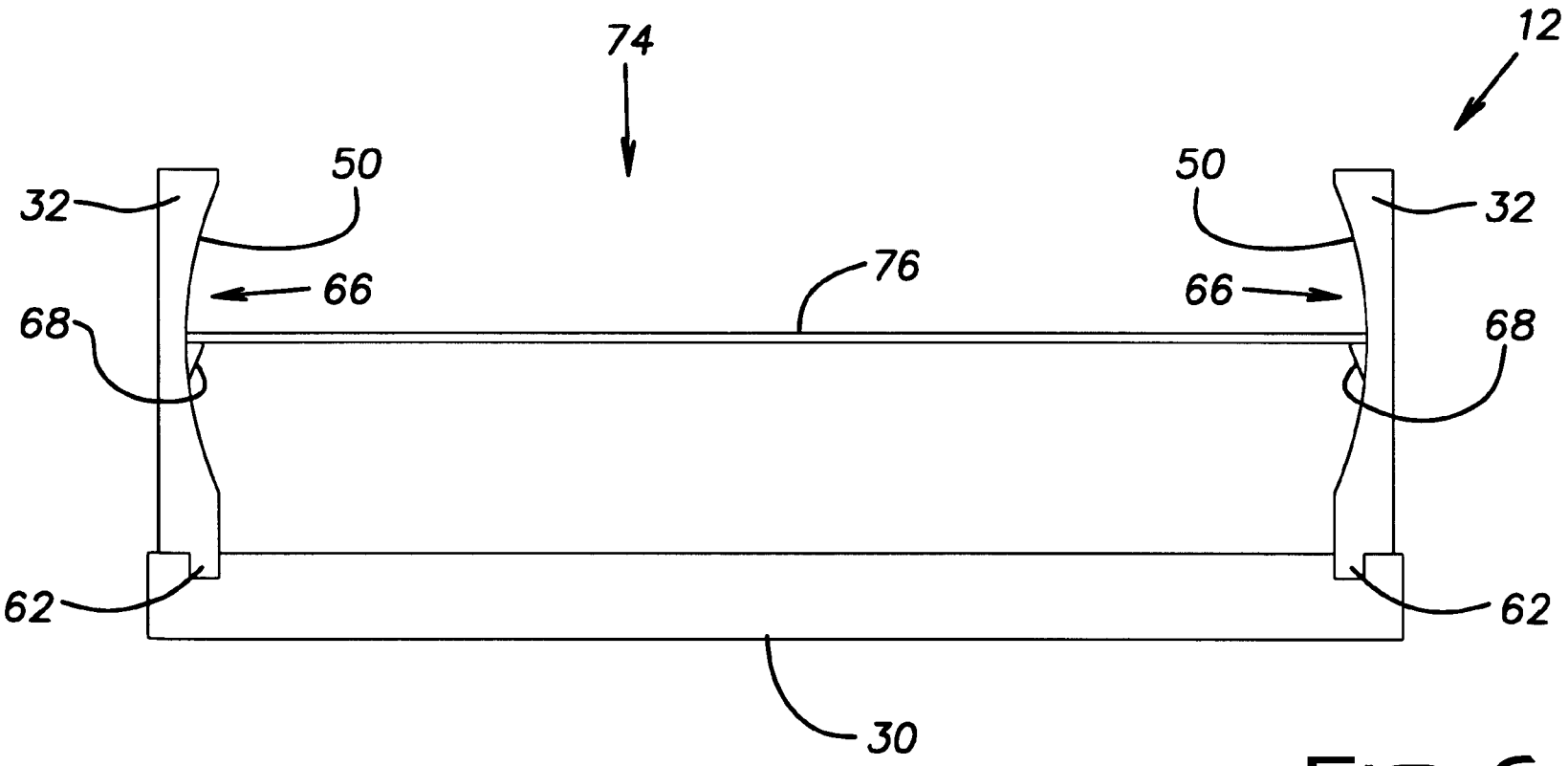
FIG. 6 shows a rear view of a second embodiment of the baking device.

Referring to FIG. 6, shelf supports such as lips 68 or grooves are provided to the inner surface 50 of each side wall 32 at substantially the same height. The lips 68 extend the length of the side walls for receiving and supporting a wire rack 76.

Referring back to FIG. 1, baking device 12 may be utilized to bake food 78, such as loaves of bread, in oven 10. The door of oven 10 is moved to the open position and wire rack 26 is moved to a lowermost or second lowermost (as shown in FIG. 1) one of its vertical positions. Base 30 is placed on wire rack 26. Side walls 32 are then assembled on base 30 to form baking device 12, and the door is moved to the closed position. The heating system is programmed to heat baking chamber 24 to a temperature in range of about 400° F. to 550° F. A higher temperature can be used with this device, because of its thermal properties, thereby enhancing the consistency of the final baked product. Baking device 12 is allowed to absorb heat in oven 10 for a preheat period of about 30 minutes. Since baking device 12 is composed of a material having a low thermal conductivity, baking device 12 retains or stores the heat absorbed during the preheat period. This heat is slowly released during the subsequent baking of the food 78. Moreover, because of the curved configuration of device 12, it is believed that the heat absorbed is concentrated on the food 78. In a preferred embodiment, the combination of base 30 and walls 62 creates a substantially contiguous, partially curvilinear baking surface, and the heat is believed to thereby be more focused upon the food.

At the end of the preheat period, the door is opened and food 78 is placed in device 12. If food 78 is bread, pizza, cookies, or pastry, food 78 may be placed directly on the surface of base 30 of baking device 12. If food 78 is a casserole, red meat, poultry, or fish, food 78 is placed in an appropriate cooking vessel, which is then disposed on base 30. The door is moved to the closed position. The heating system is then programmed to heat baking chamber 24 to a baking temperature determined by the particular type of food being baked. It should be appreciated that the normal thermal loss occasioned by opening the door to the oven is minimized by the instant invention because of the special properties of cordierite, and the specific configuration of device 12.

Baking device 12 absorbs heat and emits the heat stored from the previous preheat period. Base 30 of the baking device 12 conducts heat to food 78, while side walls 32 conduct and/or radiate heat onto food 78. Although not wishing to be bound to any particular theory, it is believed that the concave recesses 66 direct radiant heat from the side walls 32 into the center of the baking device 12. Top wall 16 of oven 10 also radiates heat onto food 78 through the open top 74 of baking device 12.

The circulating hot air, the conductive and/or radiant heat from baking device 12, and the radiant heat from top wall 16 the oven 10 combine to bake food 78 in baking device 12.

If the heating system is of the type that cycles between "on" and "off" periods, baking device 12 will continue to conduct and radiate heat if the heating system cycles to an "off" period. The heat released by baking device 12 is heat stored from the preheat period and/or the previous "on" period of the heating system. Baking device 12 thereby provides an uninterrupted supply of heat to the food 78. This uninterrupted supply of heat causes food 78 to bake evenly.

Although the preferred embodiment of this invention has been shown and described, it should be understood that various modifications and rearrangements of the parts may be resorted to without departing from the scope of the invention as disclosed and claimed herein.

What is claimed is:

1. A baking device for removable insertion into an oven, the oven having an interior depth and width, and a roof and side walls, said baking device comprising:

a unitary base composed of refractory insulating material and having a planar surface; and opposing side members extending upwardly from said base, said side members being composed of refractory insulating material;

wherein the baking device creates a chamber having opposing open ends and an open top.

2. The baking device of claim 1, wherein the base substantially traverses the interior depth and width of the oven.

3. The baking device of claim 1, wherein the side members are disposed substantially proximate to the interior side wall of the oven.

4. The baking device of claim 1, wherein the height of said side members is determined in a manner sufficient to provide a distance from the uppermost portion of the base to the roof of the oven that is between 6.5 and 9.5 inches.

5. The baking device of claim 1, wherein the height of said side members is between 5 and 9.5 inches.

6. The baking device of claim 1, wherein said side members are concavely curved and the base and side walls create a contiguous, partially curvilinear baking surface resembling a "c" in cross-section.

7. The baking device of claim 1, wherein the baking device is generally channel-shaped.

8. The baking device of claim 1, wherein said refractory insulating material is cordierite ceramic.

9. The baking device of claim 8, wherein said cordierite ceramic comprises in weight percent:

| | |
|---|---|
| $SiO_2$ | about 50–60 |
| $Al_2O_3$ | about 36–40 |
| MgO | about 5–15 |
| $Fe_2O_3$ | about 0–2 |
| $TiO_2$ | about 0–1 |
| CaO | about 0–1 |
| Alkalies | about 0–1. |

10. The baking device of claim 1, wherein the side walls have concave interior surfaces.

11. The baking device of claim 10, wherein the side walls have substantially planar exterior surfaces.

12. The baking device of claim 1, wherein the base is generally rectangular, and has anterior and posterior ends and a top surface, said top surface sloping downwardly from the posterior end to the anterior end.

13. The baking device of claim 12, wherein the posterior end of the base has an inwardly-sloping bottom portion.

14. The baking device of claim 1, wherein a bore is formed in the base for receiving a thermometer, said bore having an access opening in the anterior end.

15. The baking device of claim 1, wherein the side walls are removably mounted to the base.

16. The baking device of claim 1, wherein each side wall includes a lip for supporting a shelf above the base.

17. A baking device for removable insertion into an oven, said baking device comprising:

a base having a top surface with a pair of spaced-apart grooves formed therein; and a pair of walls, each having a concave surface and an edge, said edges being adapted for disposal in the grooves of the base so as to mount the side walls to the base.

18. The baking device of claim 17, wherein the base and pair of walls is composed of a refractory insulating material.

19. The baking device of claim 18, wherein said refractory insulating material is cordierite ceramic.

20. The baking device of claim 19, wherein said cordierite ceramic comprises:

| | |
|---|---|
| $SiO_2$ | about 50–60 |
| $Al_2O_3$ | about 30–40 |
| MgO | about 5–15 |
| $Fe_2O_3$ | about 0–2 |
| $TiO_2$ | about 0–1 |
| CaO | about 0–1 |
| Alkalies | about 0–1. |

21. The baking device of claim 17, wherein the walls are mounted to the base such that the concave surfaces face each other.

22. The baking device of claim 17, wherein each of the edges is notched and has a tenon extending from a shoulder surface, said tenons being disposed in the grooves and said shoulder surfaces being disposed against the top surface of the base when the walls are mounted to the base.

23. The baking device of claim 22, wherein the base is generally rectangular and the side members are each generally rectangular.

24. The baking device of claim 22, wherein each of the walls has a substantially planar surface disposed opposite the concave surface.

25. The baking device of claim 17, wherein a bore is formed in the base for receiving a thermometer.

26. The baking device of claim 17, wherein the height of said walls is determined in a manner sufficient to provide a distance from the uppermost portion of the base to the roof of the oven that is between 6.5 and 9.5 inches.

27. The baking device of claim 17, wherein the height of said walls is between 5 and 9.5 inches.

28. The baking device of claim 17, wherein said base and pair of walls create a contiguous, partially curvilinear baking surface resembling a "c" in cross-section.

29. A baking device for removable insertion into an oven, the oven having an interior depth and width, and a roof and side walls, said baking device comprising:

a base that substantially transverses the interior depth and width of the oven and has a sloping top surface with a pair of spaced apart grooves formed therein; and a pair of walls, each having a concave surface, substantially planar exterior surface, said edges being adapted for disposal in the grooves of the base so as to mount the side walls to the base substantially proximate to the interior side walls of the oven such that the base and side walls create a contiguous, partially curvilinear baking surface resembling a "c" in cross-section;

wherein the base and side walls are substantially composed of cordierite and create a chamber having opposing open ends and an open top.

* * * * *